US007368873B2

(12) United States Patent
Kweon

(10) Patent No.: US 7,368,873 B2
(45) Date of Patent: May 6, 2008

(54) PLASMA DISPLAY PANEL

(75) Inventor: Tae-Joung Kweon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 11/299,734

(22) Filed: Dec. 13, 2005

(65) Prior Publication Data

US 2006/0132038 A1 Jun. 22, 2006

(30) Foreign Application Priority Data

Dec. 16, 2004 (KR) ..... 10-2004-0107130

(51) Int. Cl.
*H01J 17/49* (2006.01)

(52) U.S. Cl. ..... 313/582; 313/581

(58) Field of Classification Search ..... 313/581, 313/567, 162, 163, 306, 568, 582
See application file for complete search history.

(56) References Cited

U.S. PATENT DOCUMENTS 5,371,437 A * 12/1994 Amano ..... 315/169.1
2001/0004250 A1* 6/2001 Kado et al. ..... 345/60
2002/0190648 A1* 12/2002 Bechtel et al. ..... 313/582
2004/0051457 A1* 3/2004 Kimura et al. ..... 313/586
2005/0285523 A1* 12/2005 Fujitani ..... 313/582

FOREIGN PATENT DOCUMENTS

KR 1020010037481 A1 5/2001
KR 1020030018277 A1 3/2003

* cited by examiner

*Primary Examiner*—Vip Patel
(74) *Attorney, Agent, or Firm*—H. C. Park & Associates, PLC

(57) ABSTRACT

A plasma display panel, including a front substrate, a rear substrate facing the front substrate, barrier ribs formed of a dielectric material to define discharge cells between the front substrate and the rear substrate, front discharge electrodes and rear discharge electrodes located in the barrier ribs for inducing discharge in the discharge cells, phosphor layers located in a plurality of first grooves formed on the front substrate, discharge gas in the discharge cells, and black matrix layers in the barrier ribs interposed between discharge cells. Accordingly, the luminous efficiency and brightness increases, phosphor layer deterioration is reduced, and flickering due to light interference is prevented.

16 Claims, 6 Drawing Sheets

PLASMA DISPLAY PANEL

CROSS REFERENCE TO RELATED APPLICATION

This application claims priority to and the benefit of Korean Patent Application No. 10-2004-0107130, filed on Dec. 16, 2004, which is hereby incorporated by reference for all purposes as if fully set forth herein.

BACKGROUND OF THE INVENTION

1. Field of the Invention

The present invention relates to a plasma display panel, and more specifically, a plasma display panel with a new structure.

2. Discussion of the Background

Recently, plasma flat display devices have been widely considered to be the next generation in large flat display devices, due to their excellent characteristics of high image quality, ultra slimness, low weight, wide viewing angle, and large screen size, aided by their simple manufacturing methods and ease of upscaling compared to other flat display devices.

In a conventional three-electrode surface discharge type plasma display panel 100 shown in FIG. 1, around 40% of the visible light radiated by a phosphor layer 110 is absorbed by scan electrodes 106, common electrodes 107, and bus electrodes 108, which are arranged on a bottom surface of a front substrate 101, a dielectric layer 109 covering the scan electrodes 106, the common electrodes 107, and the bus electrodes 108, and a MgO layer 111, thereby resulting in low luminous efficiency.

In addition, if the conventional three-electrode surface discharge type plasma display panel 100 displays the same image for a long time, a permanent image burn-in may result, since the phosphor layer 110 is ion-sputtered by charged particles of discharge gas. In particular, discharge occurring due to a voltage difference between the scan electrodes 106 and address electrodes 103 during address discharge and sustain discharge deepens the permanent image burn-in in the phosphor layer 110.

Furthermore, since in the conventional three-electrode surface discharge type plasma display panel 100 white light emitted from adjacent discharge cells 115 during discharge are fully separated from one another while radiating to the outside through the front substrate 101, a flickering effect is caused by interference, and therefore it is not optimal for quickly displaying frames of a moving picture.

SUMMARY OF THE INVENTION

This invention provides a plasma display panel with a new structure.

Additional features of the invention will be set forth in the description which follows, and in part will be apparent from the description, or may learned by practice of the invention.

The present invention discloses a plasma display panel including a front substrate, a rear substrate arranged opposite from the front substrate, a plurality of barrier ribs formed of a dielectric material, arranged between the front substrate and rear substrate, and defining discharge cells together with the front substrate and the rear substrate, a front discharge electrode arranged in a first barrier rib, a rear discharge electrode arranged in the first barrier rib and separated from the front discharge electrode by a predetermined distance, a phosphor layer arranged in a plurality of first grooves formed in the front substrate; and discharge gas arranged in the discharge cells.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
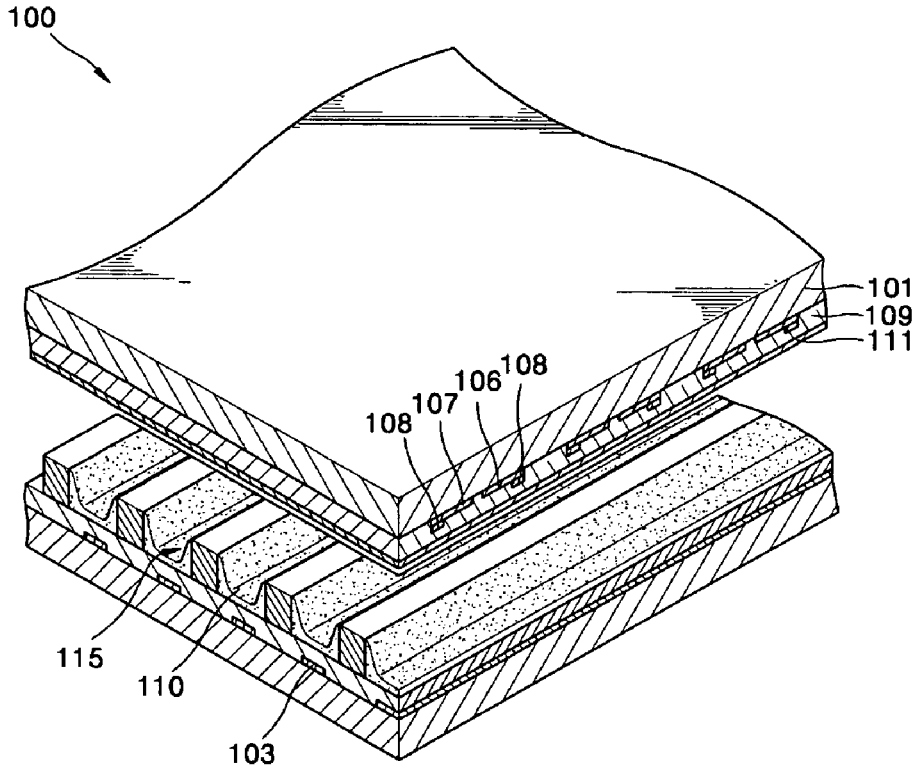
FIG. 1 (PRIOR ART)
FIG. 1 shows a partial perspective view of a conventional plasma display panel.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

When an element such as a layer or region is referred to as being "on" another element, it can be directly on the other element or intervening elements may also be present. In contrast, when an element is referred to as being "directly on" another element, there are no intervening elements present.

Figure 2:
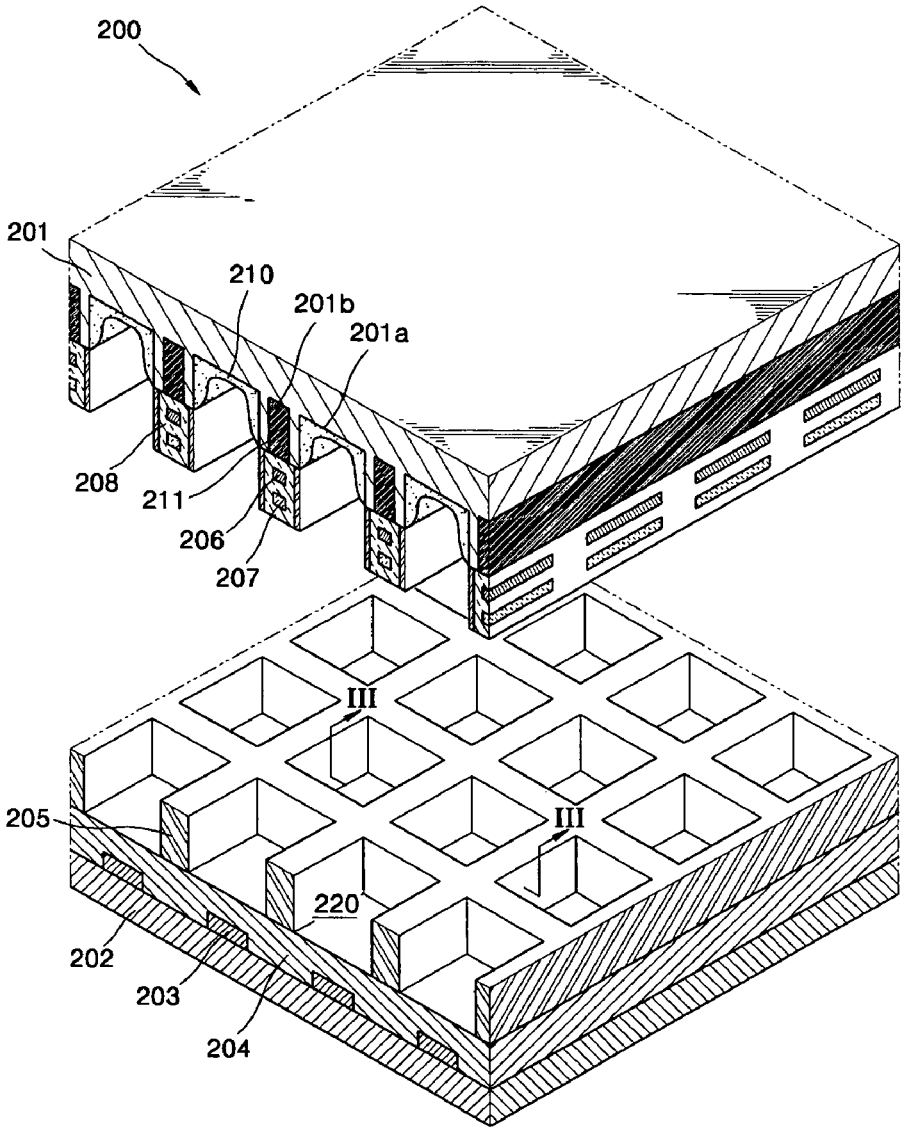
FIG. 2 shows an exploded perspective view of a plasma display panel according to an embodiment of the present invention.
Figure 3:
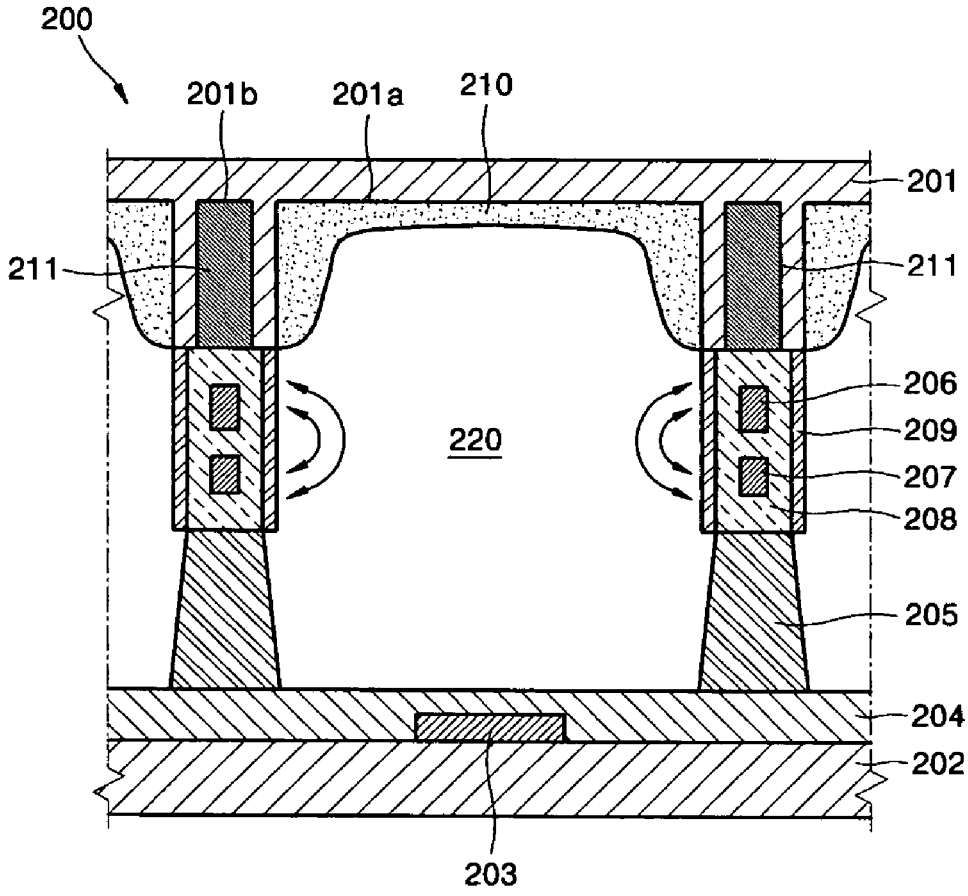
FIG. 3 shows a cross-sectional view taken along line III-III in FIG. 2.
Figure 4:
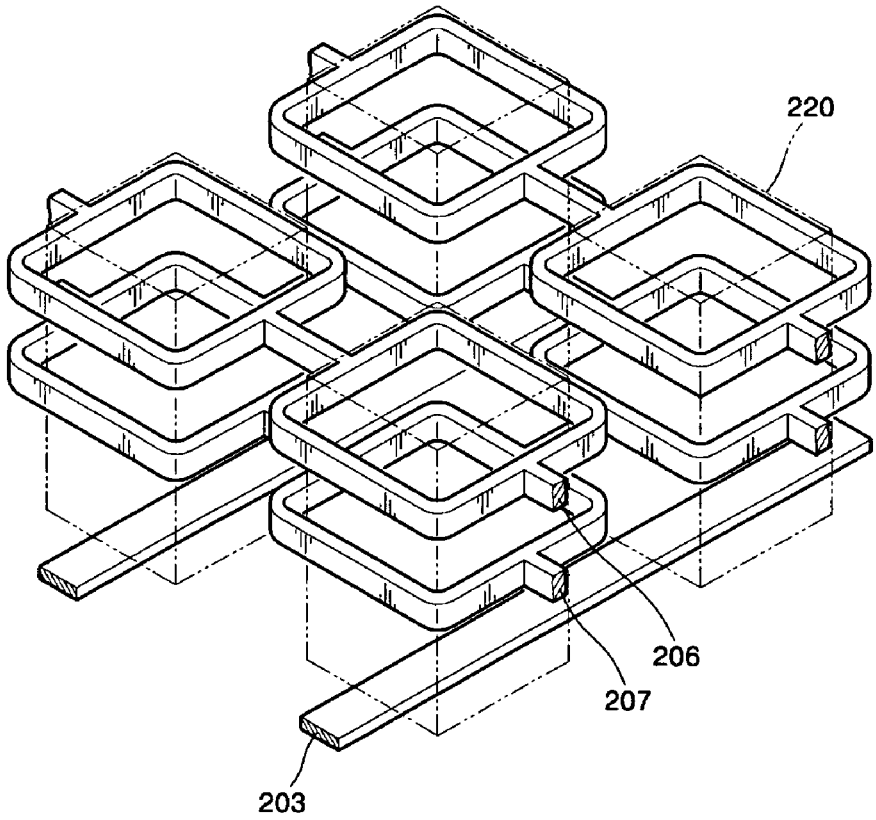
FIG. 4 shows an arrangement of electrodes and discharge cells in FIG. 2.

Referring to FIG. 2 and FIG. 3, a plasma display panel 200 according to an embodiment of the present invention includes a front substrate 201, a rear substrate 202 facing the front substrate 201, barrier ribs 208, which are arranged between the front substrate 201 and the rear substrate 202 and formed of a dielectric material, that define discharge cells 220 with the front substrate 201 and the rear substrate 202, front discharge electrodes 206 and rear discharge electrodes 207 located in the barrier ribs 208 to surround the discharge cells 220 and electrically insulated from one another and extending parallel to each other as shown in FIG. 4, address electrodes 203 located on the rear substrate 202 and arranged to cross perpendicular to the front discharge electrodes 206 and rear discharge electrodes 207, phosphor layers 210 arranged in the discharge cells 220, discharge gas (not shown) in the discharge cells 220, and dark-colored black matrix layers 211 arranged above the barrier ribs 208 and surrounding the upper side perimeter of the discharge cells 220 so that interference of visible rays generated by the discharge cells 220 can be reduced or prevented. A dielectric layer 204 may cover the address electrodes 203, and a protective layer 209, which may be a MgO layer, may cover the barrier ribs 208.

The phosphor layers 210 are arranged in first grooves 201*a* on the front substrate 201 facing the discharge cells 220. The first grooves 201*a* can be formed on the front substrate 201 by etching or sandblasting, although various other methods can also be used. Since the visible rays emitted from the phosphor layers 210 can pass directly through the front substrate 201, the front transmittance can dramatically increase.

The barrier ribs 208 defining the plurality of discharge cells 220 are positioned between the front substrate 201 and the rear substrate 202. In the present embodiment, the barrier ribs 208 define the plurality of discharge cells 220, which each have a substantially rectangular cross-section. However, the shape of the barrier ribs 208 is not limited to rectangular and can be varied provided that they define a plurality of discharge cells. For example, the barrier ribs 208 may be shaped to define waffle-shaped or delta-shaped discharge cells. In addition, the barrier ribs 208 may be shaped to define discharge cells with polygonal horizontal sections, for example, triangular, pentagonal, rectangular, circular, or oval.

In the barrier ribs 208, the front discharge electrodes 206 and the rear discharge electrodes 207, which extend parallel to each other and surround the perimeter of discharge cells 220 arranged in one direction, are disposed. The front discharge electrodes 206 and the rear discharge electrodes 207 are electrically insulated from each other and are sequentially formed on the front substrate 201.

Since the front discharge electrodes 206 and the rear discharge electrodes 207 do not block the transmission of visible rays to the front, they can be formed of a conductive metal such as aluminum or copper. Since a voltage drop in the longitudinal direction of the electrodes is small due to the use of a conductive metal, stable signal transfer is possible. Accordingly, if an image is displayed at a conventional brightness, electrodes 206 and 207 can be driven at a relatively low voltage, thereby dramatically increasing the luminous efficiency.

The barrier ribs 208 can be formed using a dielectric material that can accumulate wall charges by inducing electric charges. In this embodiment, adjacent front discharge electrodes 206 and rear discharge electrodes 207 are prevented from being electrically connected to each other, and positive ions or electrons are prevented from directly colliding with and damaging the front discharge electrodes 206 and the rear discharge electrodes 207.

The dark-colored black matrix layers 211 are arranged in second grooves 201*b* formed on the bottom surface of the front substrate 201. The second grooves 201*b* can be formed using various methods, such as etching or sandblasting, although various other methods can also be used. Thus, as shown in FIG. 3, since the dark-colored black matrix layers 211 surrounding the phosphor layers 210 can reduce flickering by reducing light interference between the discharge cells 220 during light emission, the brightness and luminous efficiency can be maximized. Furthermore, since the dark-colored black matrix layers 211 enhance the bright room contrast by absorbing external light, panels with improved contrast can be produced. Although the embodiment illustrated in FIG. 2 and FIG. 3 shows the first grooves 201*a* and the second grooves 201*b* arranged separate from each other, they can be integrally formed in one body, and are not limited to the structure shown in FIG. 2 and FIG. 3.

Further, the dark-colored black matrix layers 211 are not necessarily black, and can have any dark color that absorbs light to improve the panel's contrast.

Figure 5:
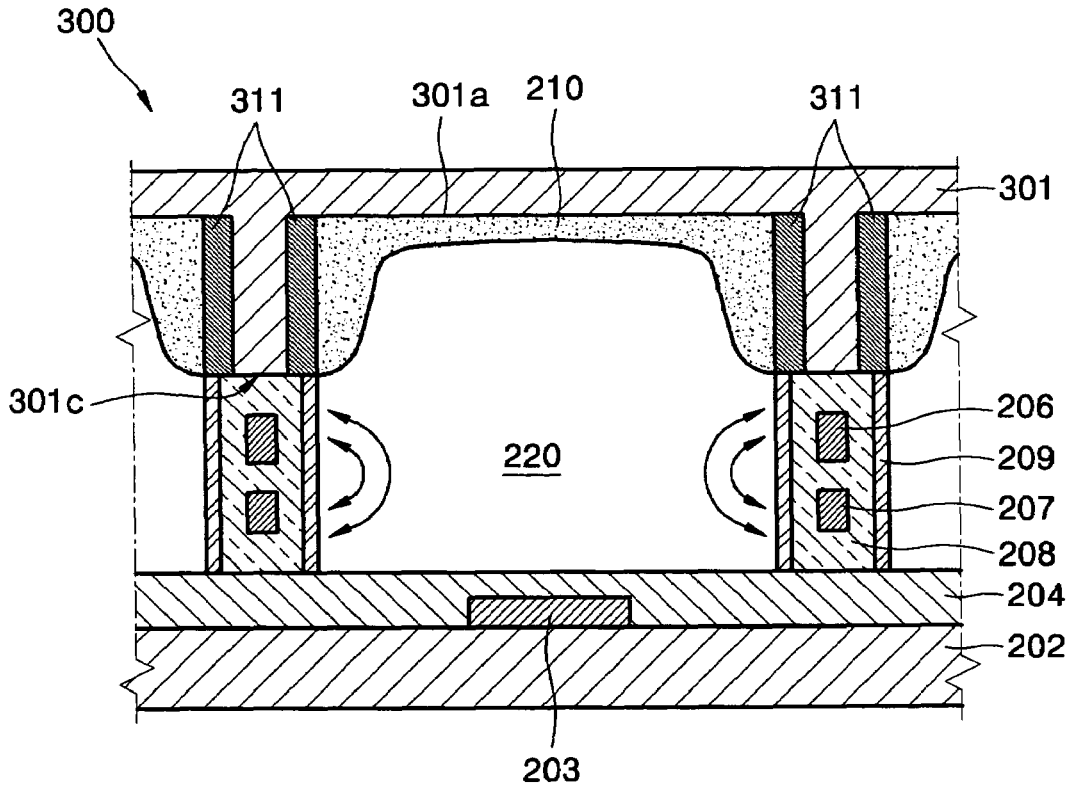
FIG. 5 shows a cross-sectional view of a plasma display panel according to another embodiment of the present invention.

FIG. 5 shows a plasma display panel 300 according to another embodiment of the present invention. In FIG. 5, elements which are referred to in the previous drawings are denoted by the same reference numerals as used in the previous drawings. Referring to FIG. 5, grooves 301*a* are formed in a front substrate 301 with a predetermined depth, and the widths of bottom portions 301*c* of the front substrate 301 that face barrier ribs 208 are smaller than the widths of the barrier ribs 208. Dark-colored black matrix layers 311 are arranged in loop shapes to surround inner perimeters of the grooves 301*a*, and phosphor layers 210 are arranged in the grooves 301*a* and on the vertical surfaces of the dark-colored black matrix layers 311.

Figure 6:
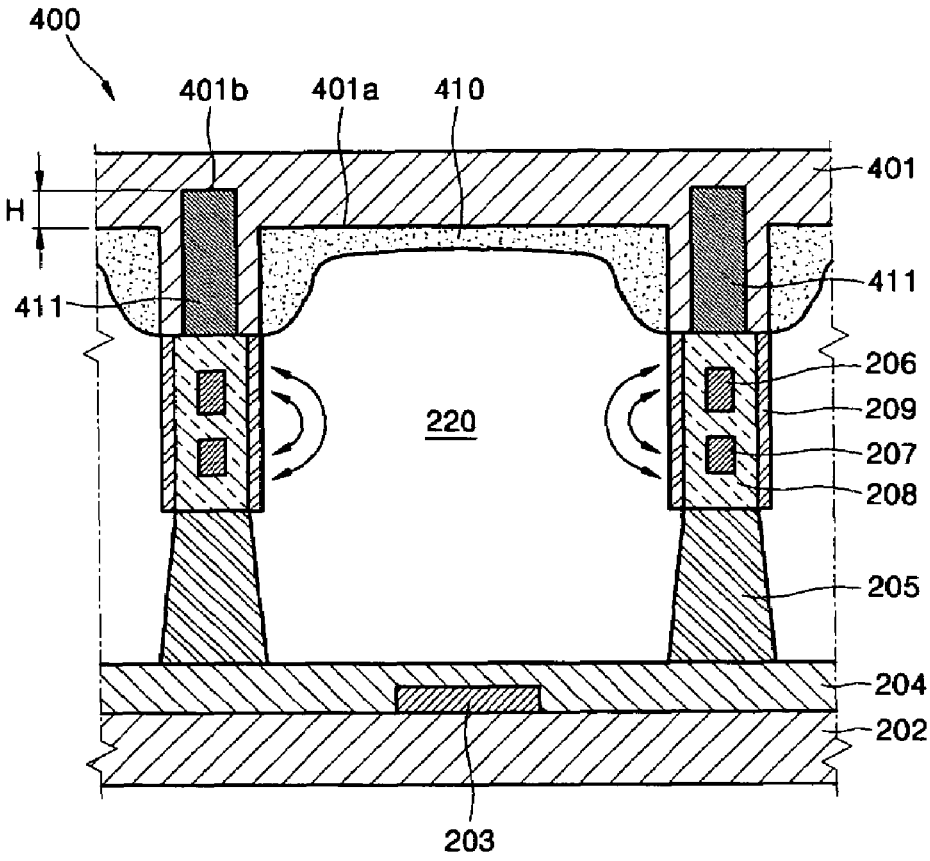
FIG. 6 shows a cross-sectional view of a plasma display panel according to another embodiment of the present invention.

FIG. 6 shows a plasma display panel 400 according to another embodiment of the present invention. In FIG. 6, elements which are referred to in the previous drawings are denoted by the same reference numerals as used in the previous drawings. Referring to FIG. 6, first grooves 401*a* and second grooves 401*b* are formed in a front substrate 401, phosphor layers 410 are arranged in the first grooves 401*a*, and black matrix layers 411 are arranged in the second grooves 401*b*. To further increase the light separation capability of the black matrix layers 411, the second grooves 401*b* can be deeper than the first grooves 401*a* by a predetermined depth H.

Referring back to FIG. 2 and FIG. 3, on the rear substrate 202, the address electrodes 203 are arranged parallel to each other, crossing each row of the discharge cells 220. The address electrodes 203 are perpendicular to the direction in which the front discharge electrodes 206 and the rear discharge electrodes 207 extend. While one address electrode 203 is positioned in each discharge cell 220 in the present embodiment, a plurality of address electrodes 203 can be used in the present invention without limitation of number. The address electrodes 203 perform address discharge to aid sustain discharge between the front discharge electrodes 206 and rear discharge electrodes 207, by decreasing a sustain discharge firing voltage. The present invention is not limited to a structure including the address electrodes 203. If the address electrodes 203 do not exist, the front discharge electrodes 206 and rear discharge electrodes 207 can extend to cross each other. In this case, either a front discharge electrode 206 or a rear discharge electrode 207 can be a scan electrode, and the other can be used as an address electrode.

As shown in FIG. 2 and FIG. 3, the plasma display panel 200 according to the embodiment of the present invention may further include rear barrier ribs 205 arranged between the barrier ribs 208 and the rear substrate 202 to define the discharge cells 220 together with the barrier ribs 208. Although the rear barrier ribs 205 are illustrated in a matrix shape in FIG. 2, the shape of the rear barrier ribs 205 is not limited thereto and can be formed in various patterns, for example, a stripe pattern for open type barrier ribs, a waffle, matrix, or delta pattern for closed type barrier ribs, provided that the rear barrier ribs 205 can define a plurality of discharge cells. In addition, closed type barrier ribs can be shaped to define discharge cells with polygonal horizontal sections, for example, triangular, pentagonal, circular, or oval, in addition to rectangular described in the present embodiment. Furthermore, as illustrated in FIG. 2, the barrier ribs 208 and the rear barrier ribs 205 can have the same shape. Alternatively, the barrier ribs 208 and the rear barrier ribs 205 may have different shapes.

The phosphor layers 210 contain components that can generate visible light by receiving ultraviolet rays. The phosphor layers 210 formed in red-light-emitting subpixels can contain a phosphor such as $Y(V,P)O_4$:Eu, the phosphor layers 210 formed in green-light-emitting subpixels contain a phosphor such as $Zn_2SiO_4$:Mn and $YBO_3$:Tb, and the phosphor layers 210 formed in blue-light-emitting subpixels can contain a phosphor such as BAM:Eu.

Discharge gas, such as Ne, Xe, or a mixture of Ne and Xe, is sealed in the discharge cells 220. According to the present invention, the discharge surface and the discharge area increase, and the amount of plasma increases, thereby enabling low-voltage driving. Since low voltage driving is possible even if high concentration Xe gas is used as the discharge gas, the luminous efficiency may improve significantly over conventional plasma display panels, in which low voltage driving is very difficult when high concentration Xe discharge gas is used.

In the plasma display panel 200 according to an embodiment of the present invention, address discharge includes applying an address voltage between the address electrodes 203 and the rear discharge electrodes 207, to select corresponding discharge cells 220. When an AC sustain discharge voltage is applied between the front discharge electrodes 206 and the rear discharge electrodes 207 of the selected discharge cells 220, the sustain discharge occurs between the front discharge electrodes 206 and the rear discharge electrodes 207. Ultraviolet rays are emitted when the energy level of the discharge gas drops after being excited by the sustain discharge.

The emitted ultraviolet rays excite the phosphor layers 210 coated in the discharge cells 220, visible rays are emitted when the energy level of the excited phosphor layers 210 drops, and the emitted visible rays form an image on the plasma display panel.

In a conventional plasma display panel, as shown in FIG. 1, since sustain discharge between a scan electrode 106 and a common electrode 107 occurs horizontally as a surface discharge, the discharge area is relatively narrow.

However, the sustain discharge in the plasma display panel 200 according to the present embodiment occurs on all sides defining the discharge cells 220, and the discharge area is relatively large. A sustain discharge in the present embodiment occurs along the perimeter of a discharge cell 220 and gradually diffuses toward the center of the discharge cell 220. As a result, the area of a region in which sustain discharge occurs increases, and space charges in the discharge cells, which have rarely been used in the prior art, help light emission, thereby improving the luminous efficiency of the plasma display panel.

In addition, in the plasma display panel 200 according to the present embodiment, since sustain discharge occurs mainly in the discharge cells 220 defined by the barrier ribs 208 as shown in FIG. 3, ion sputtering of charged particles against the phosphor layer 210, which is a problem in conventional plasma display panels, is prevented. Due to this, even if the same image is displayed for an extended duration of time, no permanent image burn-in is generated.

In a plasma display panel according to the present invention, by locating phosphor layers on a front substrate, the luminous efficiency increases, deterioration of the phosphor layers is reduced, and the brightness increases. In addition, by separating light emitted from adjacent discharge cells with black matrix layers, flickering due to light interference can be prevented.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a front substrate;

a rear substrate facing the front substrate;

a plurality of barrier ribs defining discharge cells together with the front substrate and the rear substrate;

a front discharge electrode arranged in a first barrier rib;

a rear discharge electrode arranged in the first barrier rib and separated from the front discharge electrode;

a phosphor layer arranged in a plurality of first grooves formed in the front substrate;

discharge gas arranged in the discharge cells; and a black matrix layer, wherein the black matrix layer is arranged between the first barrier rib and the front substrate and around a discharge cell, and wherein the black matrix layer is arranged in second grooves formed in the front substrate, the second grooves facing the barrier ribs.

2. The plasma display panel of claim 1, wherein the first grooves are formed to correspond to the discharge cells.

3. The plasma display panel of claim 1, wherein the first grooves are formed by etching.

4. The plasma display panel of claim 1, wherein the second grooves are formed deeper in the front substrate than the first grooves.

5. The plasma display panel of claim 1, wherein the second grooves are formed by etching.

6. The plasma display panel of claim 1, wherein the first grooves and the second grooves are integrally formed in one body.

7. The plasma display panel of claim 1, wherein the black matrix layer is arranged in a loop and to surround an inner perimeter of the second grooves.

8. The plasma display panel of claim 1, wherein the front discharge electrode extends to surround discharge cells arranged in a first direction, and the rear discharge electrode extends to surround discharge cells arranged in a second direction perpendicular to the first direction.

9. The plasma display panel of claim 1, further comprising:

an address electrode, wherein the front discharge electrode and the rear discharge electrode extend parallel to each other to surround discharge cells arranged in a first direction, and the address electrode extends in a second direction perpendicular to the first direction.

10. The plasma display panel of claim 9, wherein the address electrode is positioned on the rear substrate.

11. The plasma display panel of claim 10, further comprising:

a dielectric layer covering the address electrode.

12. The plasma display panel of claim 1, wherein the phosphor layer comprises $Y(V,P)O_4$:Eu.

13. The plasma display panel of claim 1, wherein the phosphor layer comprises $Zn_2SiO_4$:Mn or $YBO_3$:Tb.

14. The plasma display panel of claim 1, wherein the phosphor layer comprises BAM:Eu.

15. The plasma display panel of claim 1, wherein the discharge gas comprises Ne, Xe, or a combination thereof.

16. The plasma display panel of claim 1, wherein the black matrix layer comprises a dark-colored material that absorbs light.

* * * * *